US007534141B1

(12) United States Patent
Wu

(10) Patent No.: US 7,534,141 B1
(45) Date of Patent: May 19, 2009

(54) EXTENSION TO ELECTRICAL CONNECTOR WITH IMPROVED CABLE TERMINATION

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/151,308

(22) Filed: May 6, 2008

Related U.S. Application Data

(63) Continuation-in-part of application No. 11/982,660, filed on Nov. 2, 2007, now Pat. No. 7,422,488.

(51) Int. Cl.
*H01R 13/648* (2006.01)

(52) U.S. Cl. ..... 439/607; 439/660

(58) Field of Classification Search ..... 439/607, 439/608, 660, 701
See application file for complete search history.

(56) References Cited

U.S. PATENT DOCUMENTS

| | | | | |
|---|---|---|---|---|
| 7,021,971 | B2 | 4/2006 | Chou et al. | |
| 7,104,848 | B1 | 9/2006 | Chou et al. | |
| 7,108,560 | B1 | 9/2006 | Chou et al. | |
| 7,125,287 | B1 | 10/2006 | Chou et al. | |
| 7,134,884 | B2 | 11/2006 | Wang et al. | |
| 2003/0139095 | A1* | 7/2003 | Yang Lee | 439/607 |
| 2005/0197011 | A1* | 9/2005 | Tsai | 439/607 |
| 2005/0227537 | A1* | 10/2005 | Peng | 439/607 |
| 2005/0245132 | A1* | 11/2005 | Huang et al. | 439/607 |
| 2006/0025015 | A1 | 2/2006 | Hu et al. | |
| 2006/0261474 | A1 | 11/2006 | Jiang et al. | |
| 2006/0286865 | A1 | 12/2006 | Chou et al. | |
| 2006/0294272 | A1 | 12/2006 | Chou et al. | |

FOREIGN PATENT DOCUMENTS

| | | |
|---|---|---|
| TW | M306723 | 2/2007 |
| TW | CN-2891389 Y | 4/2007 |
| TW | CN-2922162 Y | 7/2007 |

* cited by examiner

*Primary Examiner*—Hien Vu
(74) *Attorney, Agent, or Firm*—Wei Te Chung

(57) ABSTRACT

An electrical connector (100) comprises an insulative housing (2) extending in a front-to-back direction, a first set of contacts (3) held in the insulative housing each comprising a nonelastic contact portion (35), a second set of contacts (40) held in the insulative housing and comprising at least one pair of differential contacts (41) held in the insulative housing for transferring high-speed signals, a substrate (8) assembled to the insulative housing, and a plurality of first and second wires (5). Each of the second set of contacts comprises an elastic contact portion (41) located behind the nonelastic contact portion along the front-to-back direction. The substrate forms a plurality of first contact-connecting pads (81) and second contact-connecting pads (82) on a front end thereof to be soldered with the first and second sets of the contacts, and a plurality of first wire-connecting pads (83) and second wire-connecting pads (84) on a rear end thereof. The first and second wires are soldered with the first and second wire-connecting pads to form electrical connection with the first and second sets of the contacts. At least two second wires are soldered to a single second wire-connecting pad of the substrate to form electrical connection with a single second set of contact.

11 Claims, 12 Drawing Sheets

EXTENSION TO ELECTRICAL CONNECTOR WITH IMPROVED CABLE TERMINATION

CROSS-REFERENCE TO RELATED APPLICATIONS

This application d is a Continued-in-Part (CIP) of U.S. patent application Ser. No. 11/982,660, filed on Nov. 2, 2007 now U.S. Pat. No. 7,422,488 and entitled "EXTENSION TO ELECTRICAL CONNECTOR WITH IMPROVED CONTACT ARRANGEMENT AND METHOD OF ASSEMBLING THE SAME", which has the same inventor and assignee as the present invention, and is related to U.S. patent application Ser. No. 11/818,100, filed on Jun. 13, 2007 and entitled "EXTENSION TO UNIVERSAL SERIAL BUS CONNECTOR WITH IMPROVED CONTACT ARRANGEMENT" an

BACKGROUND OF THE INVENTION

1. Field of the Invention

The present invention relates to an electrical connector, more particularly to an electrical connector compatible to standard Universal Serial Bus (USB) 2.0 connector.

2. Description of Related Art

Recently, personal computers (PC) are used of a variety of techniques for providing input and output. Universal Serial Bus (USB) is a serial bus standard to the PC architecture with a focus on computer telephony interface, consumer and productivity applications. The design of USB is standardized by the USB Implementers Forum (USB-IF), an industry standard body incorporating leading companies from the computer and electronic industries. USB can connect peripherals such as mouse devices, keyboards, PDAs, gamepads and joysticks, scanners, digital cameras, printers, external storage, networking components, etc. For many devices such as scanners and digital cameras, USB has become the standard connection method.

As of 2006, the USB specification was at version 2.0 (with revisions). The USB 2.0 specification was released in April 2000 and was standardized by the USB-IF at the end of 2001. Previous notable releases of the specification were 0.9, 1.0, and 1.1. Equipment conforming to any version of the standard will also work with devices designed to any previous specification (known as: backward compatibility).

USB supports three data rates: 1) A Low Speed rate of up to 1.5 Mbit/s (187.5 KB/s) that is mostly used for Human Interface Devices (HID) such as keyboards, mice, and joysticks; 2) A Full Speed rate of up to 12 Mbit/s (1.5 MB/s). Full Speed was the fastest rate before the USB 2.0 specification and many devices fall back to Full Speed. Full Speed devices divide the USB bandwidth between them in a first-come first-served basis and it is not uncommon to run out of bandwidth with several isochronous devices. All USB Hubs support Full Speed; 3) A Hi-Speed rate of up to 480 Mbit/s (60 MB/s). Though Hi-Speed devices are commonly referred to as "USB 2.0" and advertised as "up to 480 Mbit/s", not all USB 2.0 devices are Hi-Speed. Hi-Speed devices typically only operate at half of the full theoretical (60 MB/s) data throughput rate. Most Hi-Speed USB devices typically operate at much slower speeds, often about 3 MB/s overall, sometimes up to 10-20 MB/s. A data transmission rate at 20 MB/s is sufficient for some but not all applications. However, under a circumstance transmitting an audio or video file, which is always up to hundreds MB, even to 1 or 2 GB, currently transmission rate of USB is not sufficient. As a consequence, faster serial-bus interfaces are being introduced to address different requirements. PCI Express, at 2.5 GB/s, and SATA, at 1.5 GB/s and 3.0 GB/s, are two examples of High-Speed serial bus interfaces.

From an electrical standpoint, the higher data transfer rates of the non-USB protocols discussed above are highly desirable for certain applications. However, these non-USB protocols are not used as broadly as USB protocols. Many portable devices are equipped with USB connectors other than these non-USB connectors. One important reason is that these non-USB connectors contain a greater number of signal pins than an existing USB connector and are physically larger as well. For example, while the PCI Express is useful for its higher possible data rates, a 26-pin connectors and wider card-like form factor limit the use of Express Cards. For another example, SATA uses two connectors, one 7-pin connector for signals and another 15-pin connector for power. Due to its clumsiness, SATA is more useful for internal storage expansion than for external peripherals.

The existing USB connectors have a small size but low transmission rate, while other non-USB connectors (PCI Express, SATA, et al) have a high transmission rate but large size. Neither of them is desirable to implement modern high-speed, miniaturized electronic devices and peripherals. To provide a kind of connector with a small size and a high transmission rate for portability and high data transmitting efficiency is much desirable. Such kind electrical connectors are disclosed in a U.S. Pat. No. 7,021,971 (hereinafter 971 patent) issued on Apr. 4, 2006. Detailed description about these connectors is made below.

From the FIGS. 4A-6H and detailed description of 971 patent, we can find that the invention material of 971 patent is to extend the length of the plug and receptacle tongue portions of the existing USB connectors and to extend depth of the receiving cavity of the existing USB connectors, thereby to accommodate additional contacts in extended areas as shown in FIGS. 4A-5H of 971 patent; or to provide the additional contacts on a reverse-side of the plug tongue portion and accordingly with regard to receptacle, to provide a lower tongue portion under a top receptacle tongue portion thereby four USB contacts are held on the top tongue portion and additional contacts are accommodated on the lower tongue portion of the receptacle. With contrast with existing USB type-A receptacle, the receptacle with top and lower tongue portion is higher in height than existing USB receptacle.

As shown in FIGS. 4C, 4D, 5C, 5D and 6C, 6D of the 971 patent, number of the additional contacts is eight. The eight additional contacts plus the four USB contacts are used collectively or in-collectively for PCI-Express, SATA or IEEE 1394 protocol as required. To make the extended-USB plug and receptacle capable of transmitting PCI-Express or SATA or IEEE 1394 signals is the main object of the 971 patent. To achieve this object, at least eight contacts need to be added. Adding eight contacts in existing USB connector is not easy. May be, only embodiments shown in 971 patent are viable options to add so many contacts. As fully discussed above, the receptacle equipped with two tongue portions or plug and receptacle both with a longer length are also clumsiness. That is not very perfect from a portable and small size standpoint.

BRIEF SUMMARY OF THE INVENTION

Accordingly, an object of the present invention is to provide an electrical connector with low profile and lower cost.

In order to achieve the above-mentioned object, an electrical connector comprises an insulative housing extending in a front-to-back direction, a first set of contacts held in the insulative housing each comprising a nonelastic contact portion, a second set of contacts held in the insulative housing and comprising at least one pair of differential contacts held in the insulative housing for transferring high-speed signals, a substrate assembled to the insulative housing, and a plurality of first and second wires. Each of the second set of contacts comprises an elastic contact portion located behind the non-elastic contact portion along the front-to-back direction. The substrate forms a plurality of first contact-connecting pads and second contact-connecting pads on a front end thereof to be soldered with the first and second sets of the contacts, and a plurality of first wire-connecting pads and second wire-connecting pads on a rear end thereof. The first and second wires are soldered with the first and second wire-connecting pads to form electrical connection with the first and second sets of the contacts. At least two second wires are soldered to a single second wire-connecting pad of the substrate to form electrical connection with a single second set of contact.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
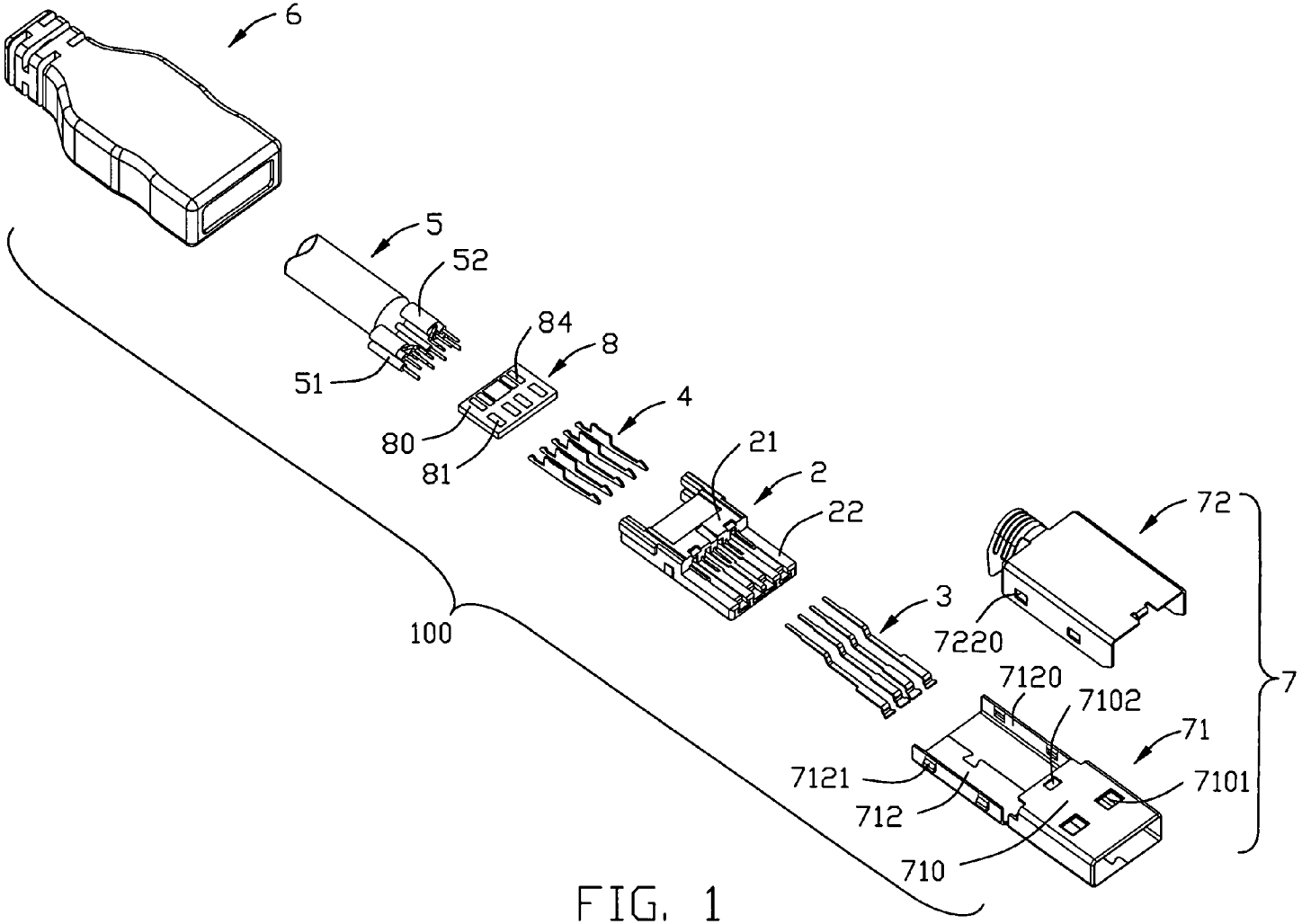
FIG. 1 is an exploded, perspective view of an extension to an electrical connector in accordance with the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Within the following description, a standard USB connector, plug, and signaling all refer to the USB architecture described within the Universal Serial Bus Specification, 2.0 Final Draft Revision, Copyright December, 2002, which is hereby incorporated by reference herein. USB is a cable bus that supports data exchange between a host and a wide range of simultaneously accessible peripherals. The bus allows peripherals to be attached, configured, used, and detached while the host and other peripherals are in operation. This is referred to as hot plugged.

Figure 2:
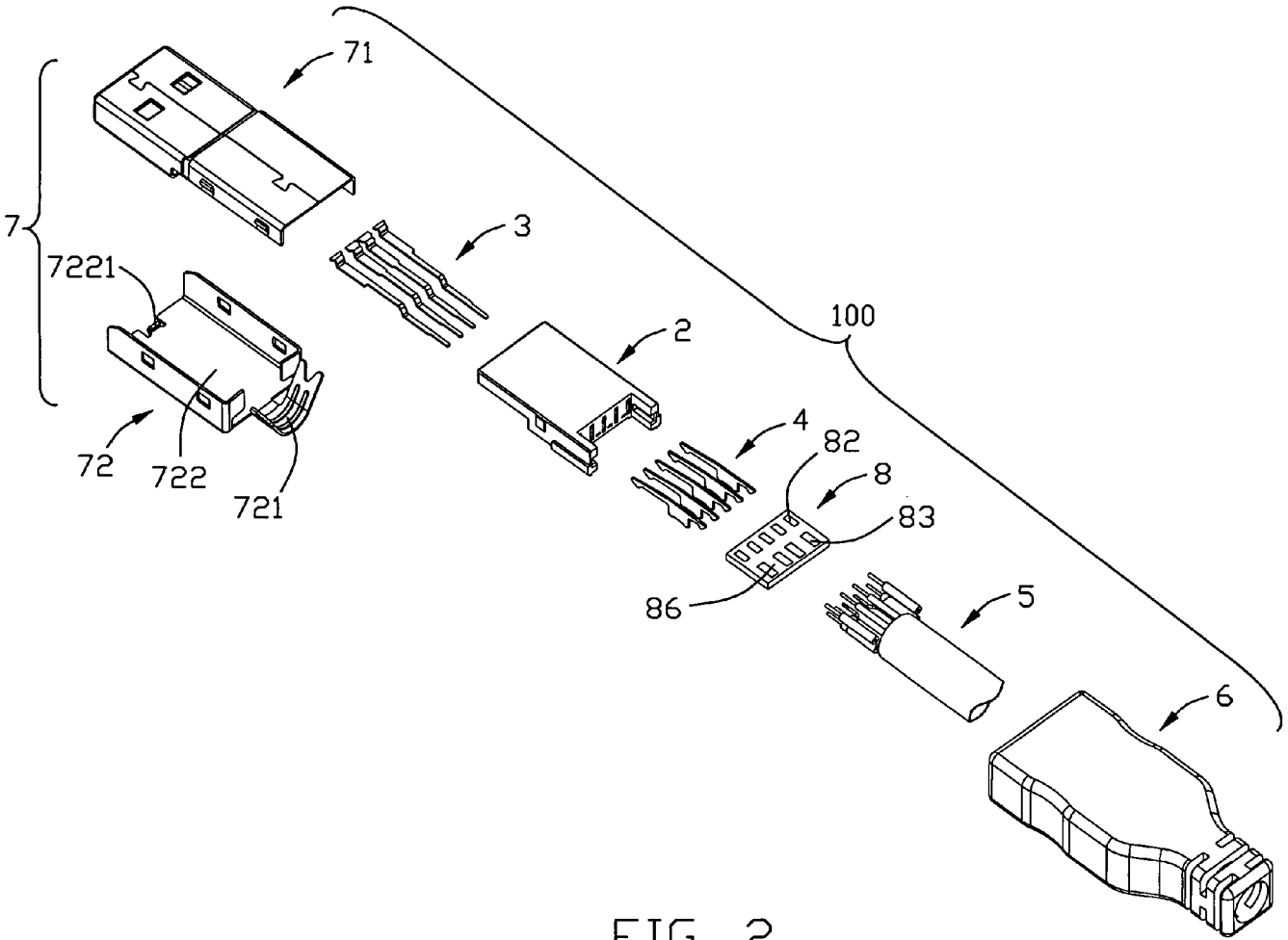
FIG. 2 is a view similar to FIG. 1, but viewed from a different aspect.

Referring to FIGS. 1-2, an extension to an electrical connector 100, that is a USB plug 100, according to the present invention is disclosed. The extension to USB plug 100 comprises an insulative housing 2 which has an insulative base portion 21 and an insulative tongue portion 22 extending from the insulative base portion 21 in a front-to-rear direction, a first set of contacts 3 and a second set of contacts 4 supported in the insulative housing 2, and a metal shell 7 enclosing the insulative housing 2 and the contacts 3, 4. Besides, a cable 5 having first and second sets of wires 51, 52, and a substrate 8 is provided to electrically connect with the contacts 3, 4 at a front end thereof and connect with the wires 51, 52 at opposite rear end thereof. In order to provide a strong structure of the extension to USB plug 100, an outer insulative cover 6 is over molded on a rear section of the insulative housing 2 together with the metal shell 7, the substrate 8 and the cable 5. The outer insulative cover 6 is adapted for being grasped by a user when the extension to USB plug 100 is used. Detail description of these elements and their relationship and other elements formed thereon will be detailed below.

Figure 3:
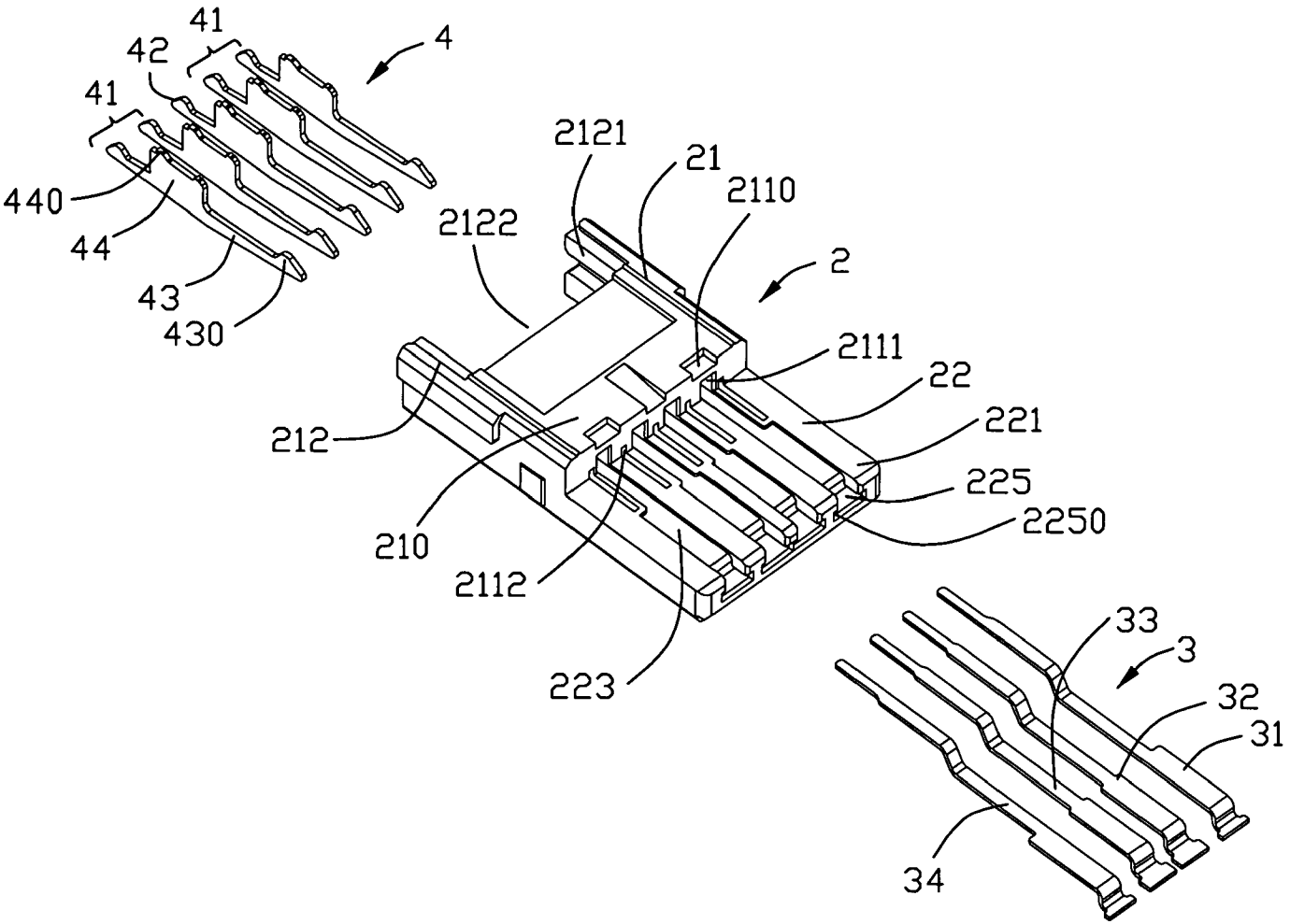
FIGS. 3-5 are enlarged views of an insulative housing and first and second sets of contacts from different aspects.

Referring to FIGS. 1-3, the base portion 21 and the tongue portion 22 of the insulative housing 2 are integrally injecting molded as a unit one piece. The base portion 21 comprises a front engaging section 211 for engaging with the metal shell 7 and a rear terminating section 212 for the termination between the contacts 3, 4 and the wires 51, 52. The engaging section 211 defines a plurality of cutouts 2110 in upper surface thereof adjacent to a front surface thereof for engaging with the metal shell 7. Four first passageways 2111 and five second passageways 2112 are alternatively arranged in one row to protrude through the base portion 21 for receiving the first and second sets of contacts 3, 4 with each first passageway 2111 wider than each second passageway 2112. The rear termination section 212 is of U-shape and comprises a pair of lateral walls 2121 rearward extending from opposite sides of the engaging section 211 to define a terminating space 2122 for exposing tail portions of the first and second sets of contacts 3, 4 and receiving the substrate 8. Each lateral wall 2121 defines a guiding slot 2123 recessed outwardly from inner surface thereof for guiding insertion of the substrate 8 into the terminating space 2122.

The tongue portion 22 has a first supporting surface 221 lower than the upper surface of the base portion 21 and opposite second supporting surface 222 coplanar with lower surface of the base portion 22. Four first passages 223 and five second passages 224 respectively recess downwardly from the first supporting surface 221 of the tongue portion 22 and are arranged in a front row and communicating with the first passageways 2111 in height direction and a rear row aligning with the second passageways 2112 in front-to-back direction. Four deeper front recesses 225 are recessed downward toward the second supporting surface 222 and communicate with corresponding first passages 223. Four slits 2250 recess inwardly from the front surface of the tongue portion 22 to communicate with the recesses 225 with wider width than that of the recess 225.

Figure 4:
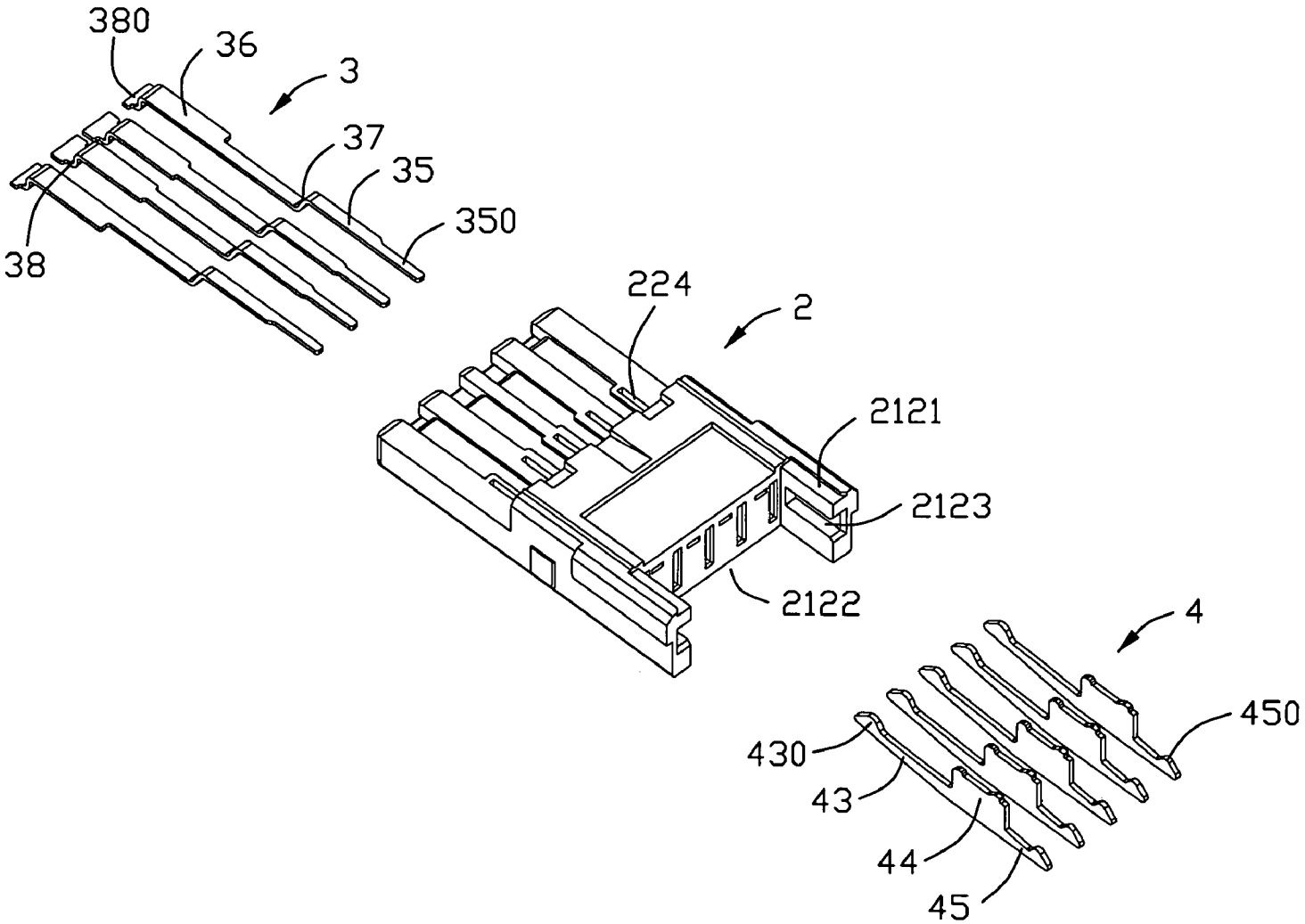
Figure 5:
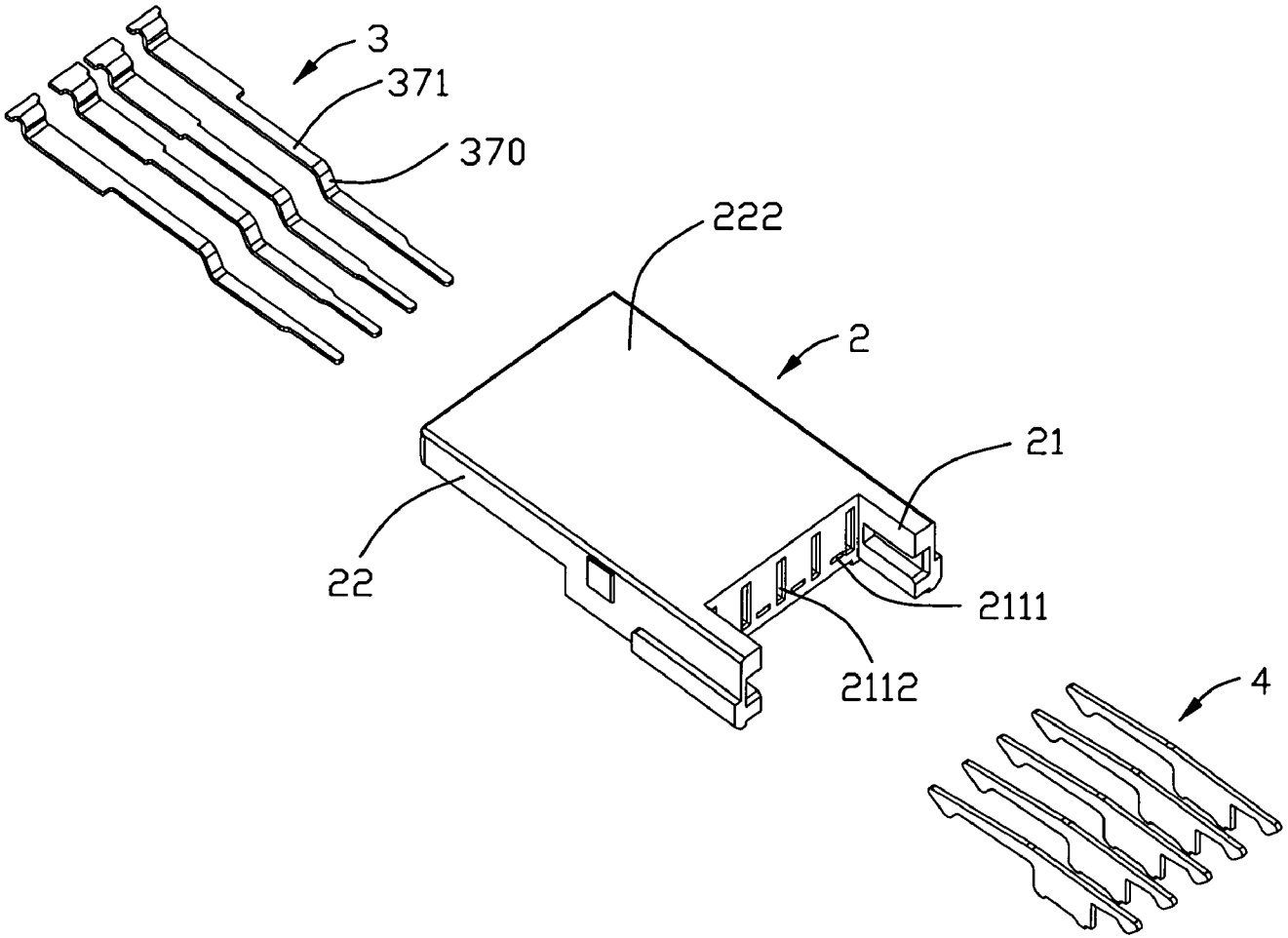
Figure 6:
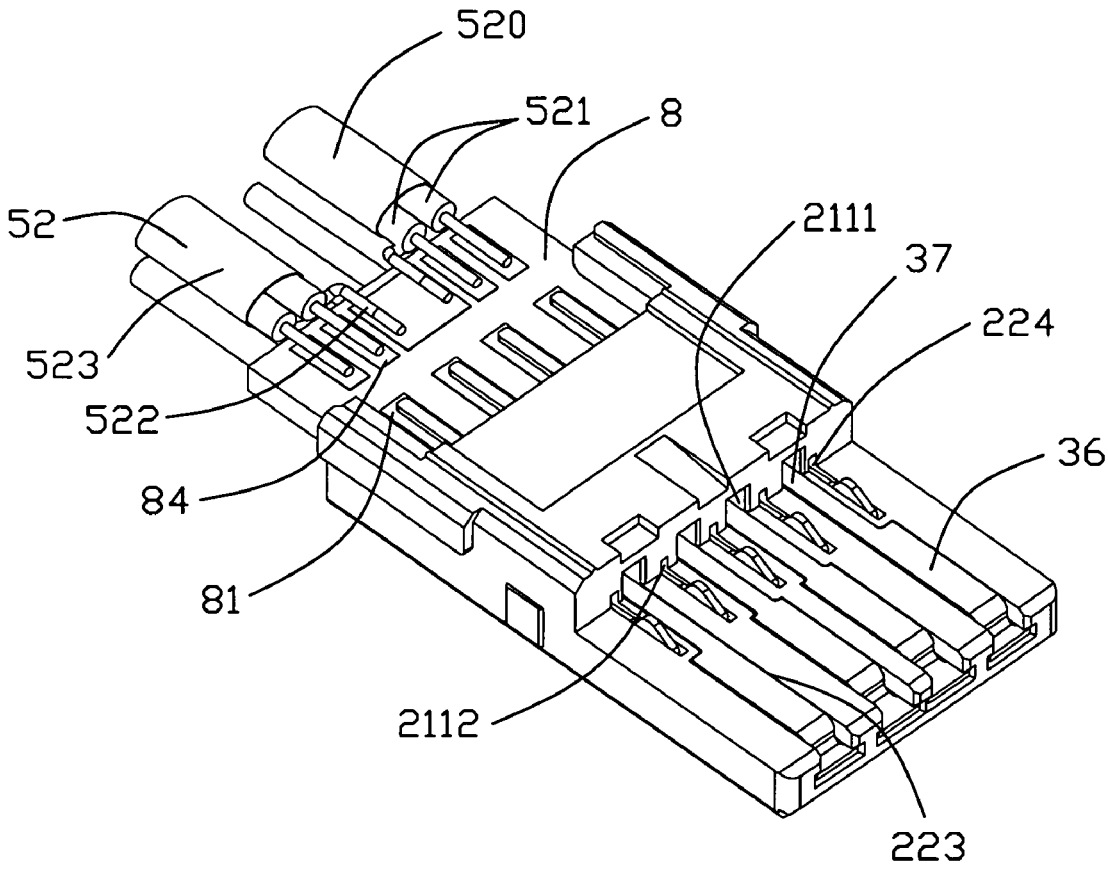
FIGS. 6-9 are partially assembled views of the extension to an electrical connector from different aspects.

Referring to FIGS. 1-3 in conjunction with FIGS. 4-6, the first set of contacts 3 include four plug conductive contacts designated with numeral 31, 32, 33 and 34. The four first contacts 3 are inserted into the insulative housing 2 from front-to-back direction. Each first contact 3 comprises a rear flat body section 35 interferentially received in the first passageways 2111 to locate in a higher plane with rear tail section 350 thereof exposed in the terminating space 2122, a flat wider contacting section 36 located in a lower plane to be embedded in the first passage 223 and coplanar with the first supporting surface 221, a substantially L-shape connecting section 37 connecting with the body section 35 and the contacting section 36 and received in both the first passageway 2111 and the first passage 223, and a front L-shape free portion 38 embedded in the recess 225 and enlarged tip end 380 interferentially engaging with the slits 2250 for preventing the upward deflection of the contacting section 36. The four first contacts 3 are juxtaposed arranged and the contacting sections 36 thereof are nonelastic. The connecting section 37 has an inclined section 370 abutting against inclined inner surface of the first passageway 2111 of the base portion 211 and a flat section 371 connecting with the wider contacting section 36 to be embedded in rear section of the first passage 223.

The additional second set of contacts 4 include two pairs of differential contacts 41 and a grounding contact 42. The two pairs of differential contacts 41 are used for transferring/receiving high-speed signals, and the grounding contact 42 is disposed between the two pairs of differential contacts 41 for preventing cross-talk. Each second contact 4 comprises a middle retention portion 44 with a higher height along vertical direction and formed with a plurality of retention tabs 440 arranged on upper edge thereof, an elastic contact portion 43 extending forwardly and upwardly gradually from lower edge of the retention portion 44 and formed with an enlarged elastic contacting end 430, and a tail portion 45 extending rearwardly and upwardly gradually from the lower edge of the retention portion 44 and formed with an enlarged connecting end 450. The second contacts 4 are inserted into the insulative housing 2 from rear-to-front direction with the retention portions 44 interferentially engaging with inner walls of the second passageways 2112 via the retention tabs 440, the elastic contact portions 43 partially received in the second passages 224 and the contacting ends 430 exposed beyond the first supporting surface 221 of the tongue portion 22, and the tail portions 45 exposed in the terminating space 2122. Thus, the differential contacts 41 and the grounding contact 42 are juxtaposed with respect to one another along the front-to-back direction. The contacting sections 36 of the four first set of contacts 31, 32, 33 and 34 occupy a majority of length of the tongue portion 22 along the front-to-rear direction with respect to that of the contact portions 43 of the additional second set of contacts 4. Meanwhile, the tail portions 45 are offset from the tail sections 350 of the first set of contacts 31, 32, 33 and 34 in a height direction perpendicular to the front-to-back direction. The tail portions 45 are located under the tail sections 350 of the first set of contacts 31, 32, 33 and 34 to prevent electrical shorting. Besides, each contact portion 43 is cantileveredly received in the second passages 224 and protrudes upwardly beyond the supporting surface 121 so that the contact portion 43 is elastic and deformable when engaging with corresponding contacts of an extension to USB receptacle (not shown). The contact portions 43 and the contacting sections 36 are separated in the front-to-back direction with no portion of them contacting one another.

The extension to USB plug 100 is compatible to existing standard USB receptacle. The geometric profile of the tongue portion 22 is same as that of the standard USB plug within an allowable tolerance. That is, length, width and height of the tongue portion 22 are substantially equal to those of the standard USB plug. An arrangement of the four first set of contacts 31, 32, 33 and 34 is compatible to that of the standard USB receptacle. The four first contacts 31, 32, 33 and 34 are for USB protocol to transmit USB signals. In detail, the four first set of contacts 31, 32, 33 and 34 are for power (VBUS) signal, – data signal, + data signal and grounding, respectively. So now, from assignment of each first contacts standpoint, different terminology are given to each of the four first set of contacts 31, 32, 33 and 34, wherein the first contacts 31, 32, 33 and 34 are respectively named as power contact 31, – data contact 32, + data contact 33 and ground contact 34.

Figure 10:
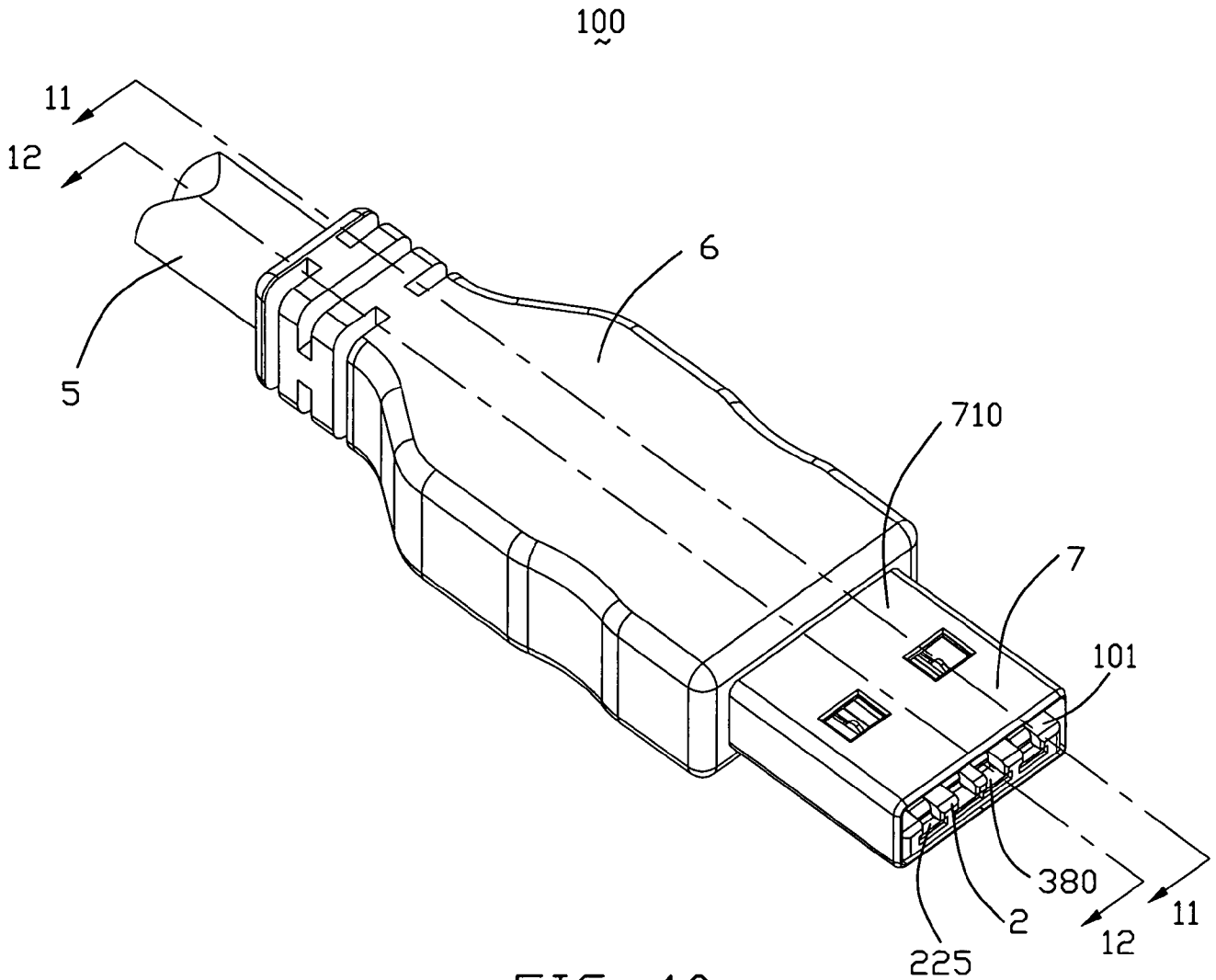
FIG. 10 is an assembled, perspective view of the extension to an electrical connector of FIG. 1.
Figure 11:
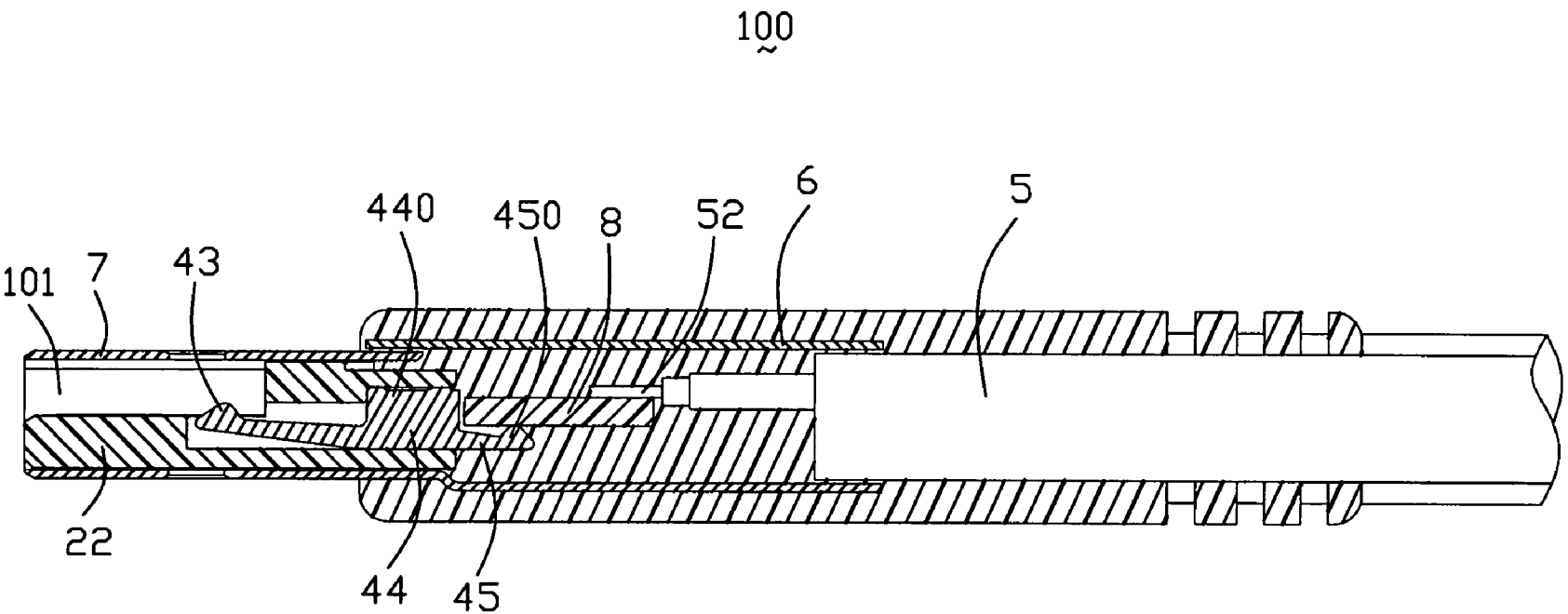
FIGS. 11-12 are cross-section views taken along lines 11-11 and 12-12 of FIG. 10.
Figure 12:
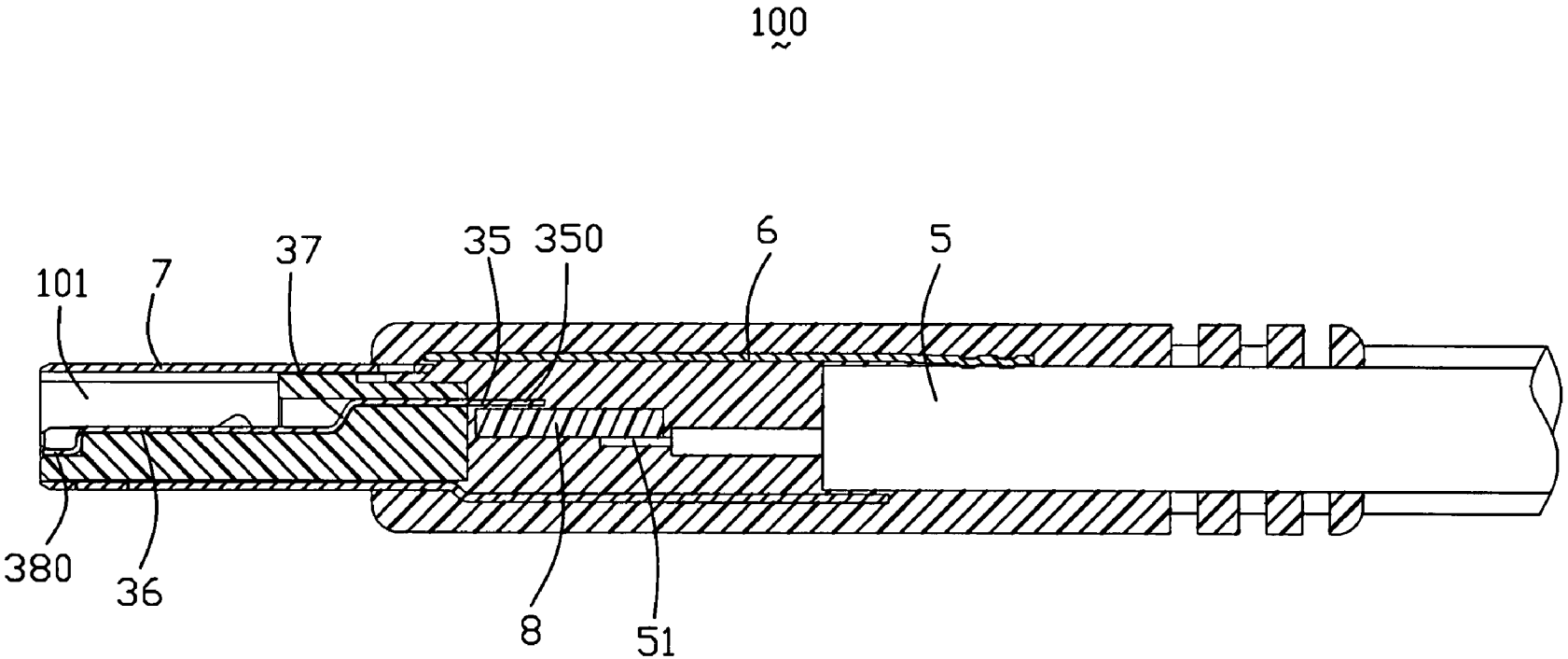

Referring to FIGS. 1-2 in conjunction with FIGS. 10-12, the metal shell 7 comprises a lower first half 71 and an upper second half 72 engaging with the first half 71 to form the whole metal shell 7. The first half 71 comprises a front tube-shape mating frame 710 and a rear U-shape holding section 712 with opposite flanges 7120 each formed with a pair of tubers 7121 bending outwardly for engaging with locking holes 7220 of the second half 72 to secure the first and second halves 71, 72. The front mating frame 710 defines two pairs of rectangular windows 7101 in upper and lower walls thereof and a rear locking opening 7102 in upper wall adjacent to the holding section 712. The second half 72 is assembled to the rear holding section 712 of the first half 71 and comprises a n-shape front holding section 722 and a rear crimping section 721 for grasping the cable 5 to realize strain relief. The holding section 722 forms two pairs of locking holes 7220 in opposite lateral walls thereof and a bending tab 7221 bending from a front edge of upper wall thereof to lock into the locking opening 7102 of the first half 71. After the metal shell 7 is assembled to the insulative housing 2, the contacts 3, 4, and the substrate 8, the mating frame 710 of the metal shell 7 touches other three sides of the tongue portion 22 except the first supporting surface 221, thus, a receiving cavity 101 circumscribed by the mating frame 710 and the first supporting surface 221 is formed. The contacting sections 36 of the first set of contacts 3 and the contact portions 43 of the second set of contacts 4 are all exposed in the receiving cavity 101 for mating with corresponding contact portions of a complementary connector. An arrangement of the metal shell 7 and the tongue portion 22 is also compatible with what of standard USB receptacle.

In the preferred embodiment of the present invention, the first set of contacts 3 are all formed of a metal sheet and separated form one another. It is also to be understood that, in other embodiments, the first contacts 31, 32, 33 and 34 can be conductive pads formed on a printed circuit board which is supported on the supporting surface 221 of the tongue portion 22. These two options to make contacts are both viable in current industry.

The substrate 8 is a flat board with certain thickness. There are four first contact-connecting pads 81 soldered with the first set of contacts 3, and five second wire-connecting pads 84 on front and rear edges of a top surface 80 thereof. There are five second contact-connecting pads 82 soldered with the second set of contacts 4 and four second wire-connecting pads 83 on front and rear edges of a bottom surface 86 thereof.

Figure 7:
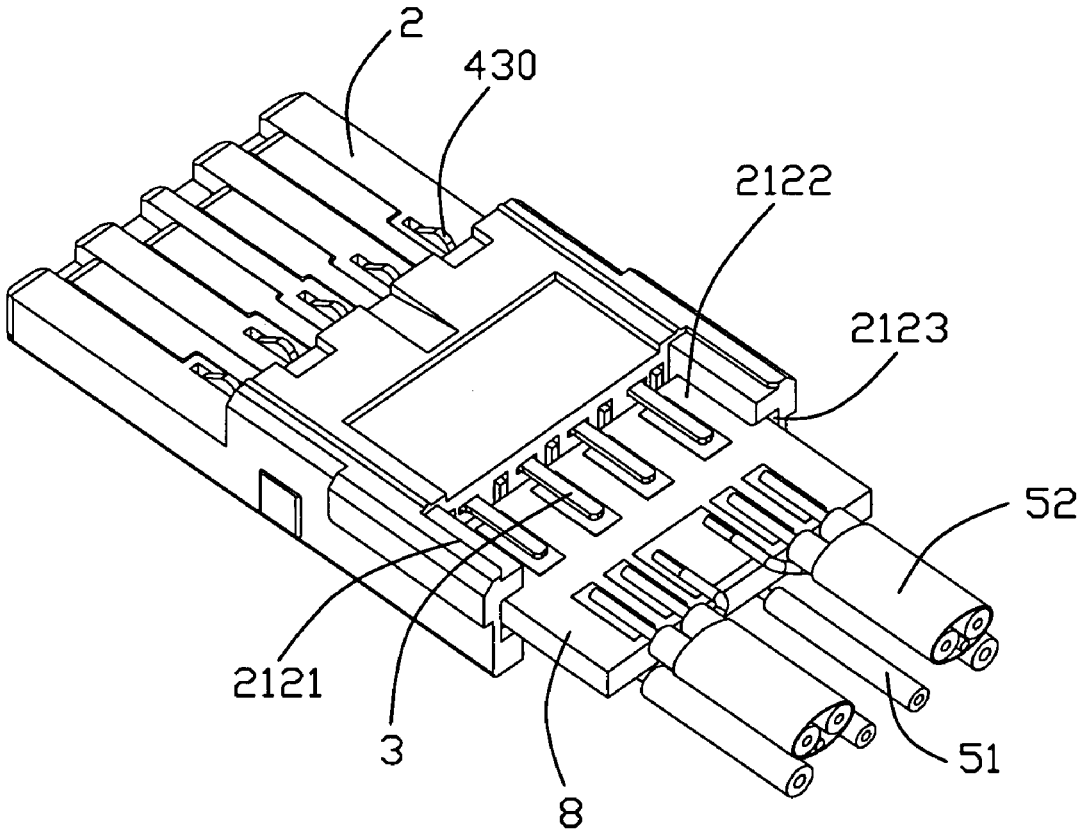
Figure 8:
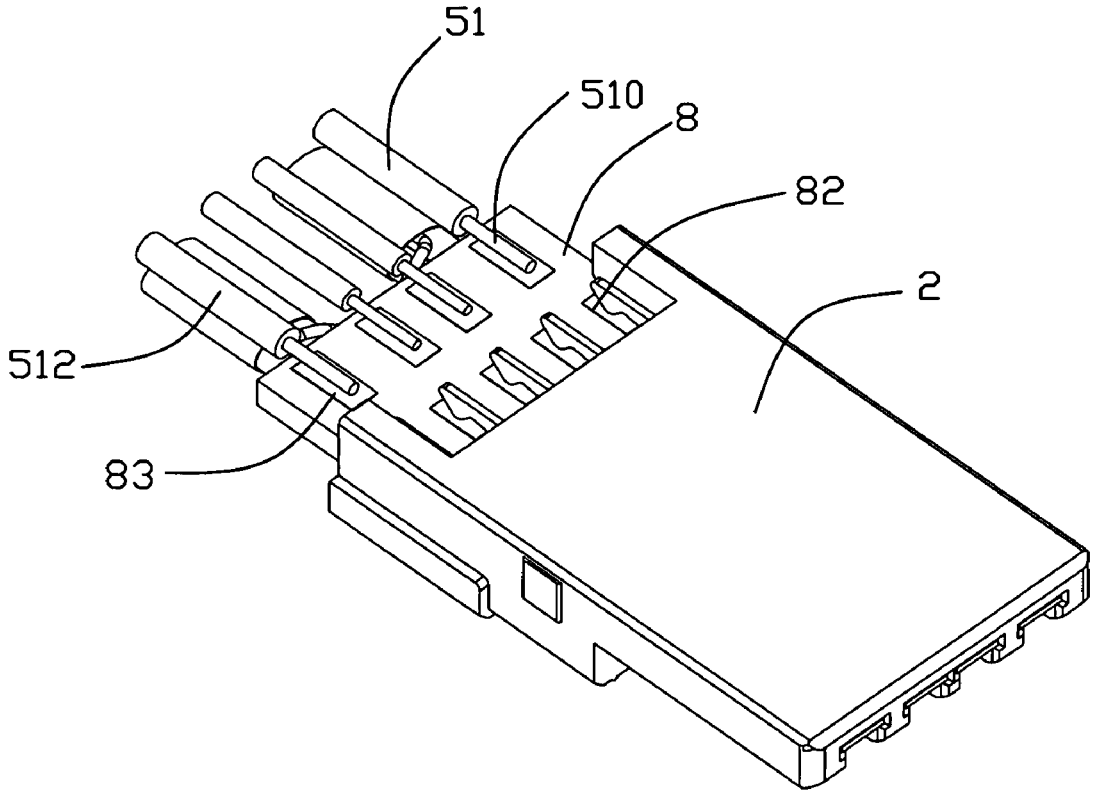
Figure 9:
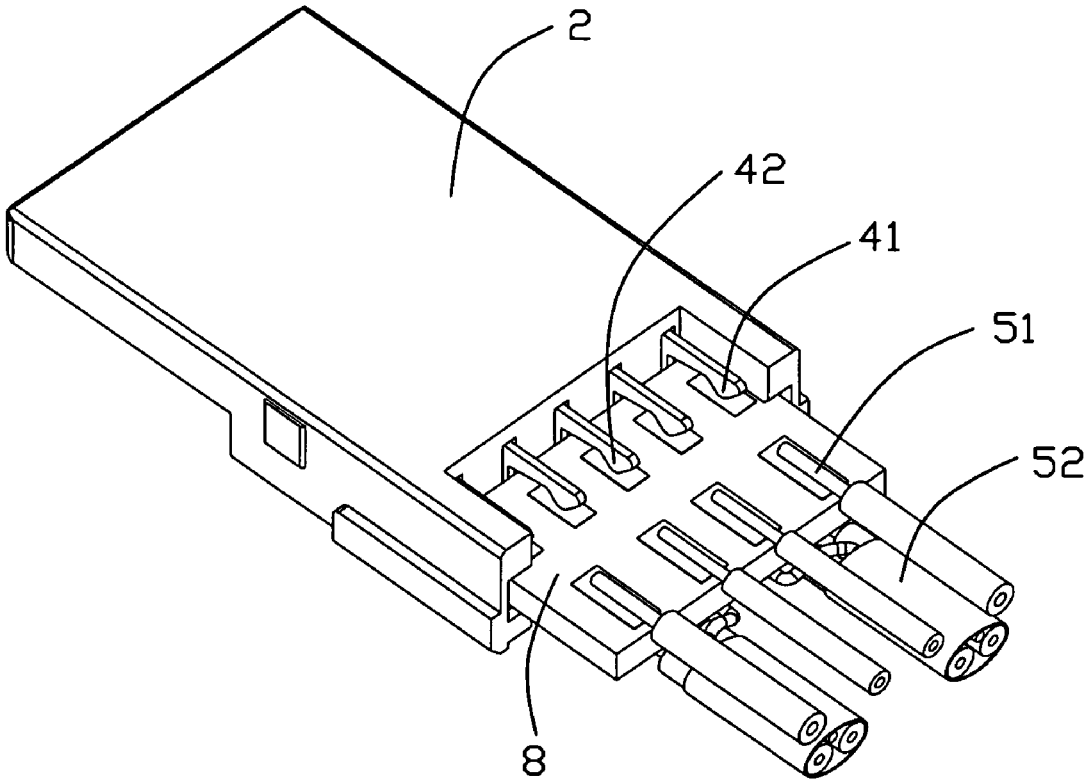

The cable 5 comprises the four first wires 51 arranged in a lower row to be soldered with the four first wire-connecting pads 83 of the substrate 8 to form electrical connection with the first set of contacts 3, and a pair of second wires 52 arranged in an upper row to be soldered with the five second wire-connecting pads 84 to form electrical connection with the second set of contacts 4. Referring to FIGS. 6-7, each first wire 51 comprises an inner conductor 510 soldered with the first wire-connecting pads 83 and an outer jacket 512 enclosing the inner conductor 510. Referring to FIGS. 8-9, the second wires 52 consist of two subassemblies 520. Each subassembly 520 comprises a pair signal wires 521 each having the same structure as that of the first wire 51, a grounding conductor 522 located adjacent to the differential pair 521, and an outer jacket 523 enclosing the differential pair 521 and the grounding conductor 522. The two signal wires 521 of the second wires 52 form a differential pair with reduced crosstalk. The signal wires 521 are soldered to four second wire-connecting pads 84, while the pair of grounding conductors 522 are both soldered to the middle wider wire-connecting pad 84. The metal shell 7 is assembled to the insulative housing 2, the contacts 3, 4, the substrate 8 and the cable 5 as described above. Then, the outer insulative cover 6 is overmolded with the metal shell 7, the cable 5.

Under the non-USB protocol, the two pairs of differential contacts 41 transfer differential signals unidirectionally, one pair for receiving data and the other for transmission data.

In the preferred embodiment of the present invention, the number of the additional second set of contacts 4 is five which consists of two pairs of differential contacts 41 and a grounding contact 42 disposed between each pair of the differential contacts 41 as best shown in FIGS. 1-2 and FIGS. 6-9. However, in alternative embodiments, the additional second set of contacts 4 can only comprise a pair of differential contacts for transmitting/receiving high-speed signals, and if necessarily, a grounding contact can be provided to be positioned on each lateral side of the pair of differential contacts.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector, comprising:

an insulative housing extending in a front-to-back direction; and a first set of contacts held in the insulative housing, each first contact comprising a nonelastic contact portion;

a second set of contacts held in the insulative housing and comprising at least one pair of differential contacts held in the insulative housing for transferring high-speed signals, and each of the second set of contacts comprising an elastic contact portion located behind the nonelastic contact portion along the front-to-back direction;

a substrate assembled to the insulative housing and forming a plurality of first contact-connecting pads and second contact-connecting pads on a front end thereof to be soldered with the first and second sets of the contacts, and a plurality of first wire-connecting pads and second wire-connecting pads on a rear end thereof;

a plurality of first and second wires soldered with the first and second wire-connecting pads to form electrical connection with the first and second sets of the contacts; and wherein at least two second wires are soldered to a single second wire-connecting pad of the substrate to form electrical connection with a single second set of contact;

wherein the first contact-connecting pads and the second wire-connecting pads are arranged on an upper surface of the substrate, the second contact-connecting pads and the first wire-connecting pads are arranged on a lower surface of the substrate, and wherein the first and second wires are arranged in two rows with the second wires are in an upper row and the first wires are in a lower row;

wherein the insulative housing comprises a tongue portion with mating portions of the first and second sets of contacts arranged on a mating surface of the tongue portion in front-to-rear relationship and a base portion behind the tongue portion, and wherein the substrate is assembled to the base portion;

wherein the first set of contacts is adapted for USB protocol and an arrangement of the first set of contacts is compatible to a standard USB receptacle, and wherein the pair of differential contacts are adapted for non-USB protocol.

2. The electrical connector as claimed in claim 1, wherein the base portion defines a terminating space and a pair of guiding slots beside the terminating space, and wherein the substrate is guided by the pair of guiding slots to be received into the terminating space.

3. The electrical connector as claimed in claim 1, further comprising a metal shell enclosing the insulative housing and forms a receiving cavity together with the mating surface of the tongue portion with the mating portions of the contacts exposed into the receiving space.

4. The electrical connector as claimed in claim 1, wherein the nonelastic contact portions of the first set of contacts are substantially coplanar with the mating surface of the tongue portion, and wherein the elastic contact portions of the second set of contacts are beyond the mating surface.

5. The electrical connector as claimed in claim 1, wherein the geometric profile of the tongue portion is substantially same as that of a standard type-A USB 2.0 plug.

6. The electrical connector as claimed in claim 1, wherein the nonelastic contact portions of the first set of contacts occupy a majority of length of the tongue portion along front-to-back direction with respect to that of the elastic contact portions of the second set of contacts.

7. The electrical connector as claimed in claim 1, wherein the first set of contacts and the second set of contacts are respectively assembled to the insulative housing from opposite front-to-back direction and back-to-front direction.

8. The electrical connector as claimed in claim 1, wherein each first set of contacts comprises an L-shape tip end formed with the nonelastic contact portion to be embedded in the insulative housing for preventing upward deflection of the nonelastic contact portion.

9. An electrical connector comprising:

an insulative housing defining a tongue portion with a mating surface thereon;

a metal shell enclosing said insulative housing and cooperating with said mating surface to form a mating port, while the other opposite surface of the tongue portion being essentially intimately shielded by said shell;

a deflectable first set of contacts disposed in the housing and extending relative adjacent to said mating surface with first contacting sections exposed upon a rear region mating surface; and a stiff second set of contacts disposed in the housing and extending relative farther from said mating surface in comparison with said first contacts while with second contact sections deflected to and exposed upon the mating surface;

a substrate assembled to the insulative housing and located behind the tongue portion with a plurality of first and second conductive pads;

a first wire and a second set of wire located behind the substrate; and the first and second contacts are soldered to the first conductive pads of the substrate and the first and second wires are soldered to the second conductive pads of the substrate to form electrical connection with the first and second contacts;

wherein the first set of contacts is adapted for USB protocol and an arrangement of the first set of contacts is compatible to a standard USB receptacle, and wherein the set of second contacts are adapted for non-USB protocol.

10. A cable connector assembly comprising:

an insulative housing defining a mating port;

a plurality of stiff first contacts and a plurality of resilient second contacts disposed in the housing, and defining mating sections commonly exposed to a same face of the mating port while soldering sections respectively mounted upon front portions of two opposite surfaces of a printed circuit board behind the housing;

a first set of cables including interior conductors soldered upon a rear portion of one of said two opposite surfaces of the printed circuit board;

a second set of cables including interior conductors soldered upon a rear portion of the other of said two opposite surfaces of the printed circuit board;

wherein the first set of cables are electrically connected to the first contacts while soldered upon the surface opposite to the surface the first contacts are mounted to;

wherein the second set of cables includes two cables each defining a pair of differential conductors and a grounding conductor under a condition that the differential conductors of each of said two cables are respectively soldered upon corresponding pads while the grounding conductors of said two cables are jointly soldered upon a common large pad; and wherein the first contacts is adapted for USB protocol and an arrangement of the first set of contacts is compatible to a standard USB receptacle, and wherein the second contacts are adapted for non-USB protocol.

11. The cable connector assembly as claimed in claim 10, wherein the second set of cables are electrically connected to the second contacts while soldered upon the surface opposite to the surface the second contacts are mounted to.

* * * * *